US007439664B2

(12) United States Patent
Galmiche et al.

(10) Patent No.: US 7,439,664 B2
(45) Date of Patent: Oct. 21, 2008

(54) LOW CONSUMPTION CATHODE STRUCTURE FOR CATHODE RAY TUBES

(75) Inventors: Christian Galmiche, Auxonne (FR); Michel Tirant, Gy (FR); François Fichet, Fontaine les Dijon (FR); Philippe Zehnder, Pointre (FR); Gérard Proudhon, Chevigny Saint Sauveur (FR)

(73) Assignee: Thomson Licensing, Boulogne Billancourt (FR)

( * ) Notice: Subject to any disclaimer, the term of this patent is extended or adjusted under 35 U.S.C. 154(b) by 87 days.

(21) Appl. No.: 11/158,211

(22) Filed: Jun. 20, 2005

(65) Prior Publication Data

US 2006/0038475 A1 Feb. 23, 2006

(30) Foreign Application Priority Data

Jun. 21, 2004 (FR) ..... 04 06738

(51) Int. Cl.
*H01J 29/46* (2006.01)
*H01J 29/00* (2006.01)

(52) U.S. Cl. ..... 313/446; 313/441; 313/451; 313/364

(58) Field of Classification Search ..... 313/451, 313/446

See application file for complete search history.

(56) References Cited

U.S. PATENT DOCUMENTS

| | | | | | |
|---|---|---|---|---|---|
| 4,063,128 | A | * | 12/1977 | Hughes | 313/409 |
| 4,912,362 | A | * | 3/1990 | Barthelemy et al. | 313/270 |
| 5,543,682 | A | * | 8/1996 | Hara et al. | 313/446 |
| 5,698,937 | A | * | 12/1997 | Ju et al. | 313/346 R |
| 2003/0164667 | A1 | * | 9/2003 | Ricaud | 313/310 |

FOREIGN PATENT DOCUMENTS

| | | |
|---|---|---|
| EP | 0 616 353 A2 | 9/1994 |
| EP | 1 347 486 A1 | 9/2003 |

OTHER PUBLICATIONS

Search Report dated Nov. 10, 2004.

* cited by examiner

*Primary Examiner*—Nimeshkumar D. Patel
*Assistant Examiner*—Natalie K Walford
(74) *Attorney, Agent, or Firm*—Joseph J. Lake; Harvey D. Fried; Richard LaPeruta

(57) ABSTRACT

Cathode structure for cathode ray tube comprising an eyelet in two separate parts positioned such that one of the parts covers, in the longitudinal direction and at least partially, the second part. The two parts are linked to each other at the shouldered ends.

This structure reduces the heat losses of the cathode and reduces its consumption while it is operating.

9 Claims, 1 Drawing Sheet

LOW CONSUMPTION CATHODE STRUCTURE FOR CATHODE RAY TUBES

This application claims the benefit, under 35 U.S.C. § 119 of French Patent Application 0406738, filed Jun. 21, 2004.

The present invention relates to a cathode structure for cathode ray tube and, more particularly, to a "low consumption" cathode structure.

BACKGROUND OF THE INVENTION

The electron guns for cathode ray tubes that use an oxide cathode are geared towards low cost, "low consumption" systems, this low consumption resulting from new designs of the parts that make up the gun or from the part assembly techniques. The reduction in power, which, according to the state of the art, is normally approximately 4.5 W for the three cathodes, to values approximating 2.1 W, entails introducing more compact and thermally optimized systems. The use of small filament and cathode are essential to achieving the low powers required but are still inadequate. To reduce said consumption, the thermal losses must be reduced while keeping the systems simple to avoid any cost overhead compared to the standard system.

A number of techniques have been explored to reduce the thermal losses of the filament cathode structure.

The first solution involves facilitating the thermal transfer between the filament and the cathode, for example by modifying the internal absorptivity of the skirt of the cathode sleeve.

To facilitate the thermal transfer between the filament and the cathode, the interior of the skirt of the cathode is blackened by deposition or treatment to promote the absorption of the heat by the skirt, the radiative transfer between the two entities then being more effective. This method is, for example, described in the U.S. Pat. No. 5,543,682.

This solution is effective in facilitating the filament-cathode transfer but requires a relatively complicated production process, such as vapour deposition and its application is therefore costly.

A second solution, as described in U.S. Pat. No. 4,558,254, consists in modifying the shape of the skirt of the cathode sleeve itself, by giving it an S-shape combined with reducing the thickness in this area, in order to augment the conduction path and reduce the passage section of the conductive flow between the hot zone of the cathode and its support.

Another solution proposed by the latter US patent consists in limiting the thermal losses by radiation towards the rear of the cathode using a long cathode with several diameters.

All these solutions are difficult to implement and are costly for producing cathode ray tubes particularly suited to television.

SUMMARY OF THE INVENTION

One object of the invention is to provide a simple and inexpensive system for assembling a cathode for electron gun with which to ensure low power consumption levels, preferably below 2.25 W for all three cathodes.

For this, the cathode for cathode ray tube electron gun according to the invention comprises:

- a cathode sleeve open at one of its ends and closed at its opposite end by a cap covered with emissive materials
- a heating filament disposed inside the sleeve and comprising a heating element and two legs extending towards the open end of said sleeve

- a first cathode eyelet securely attached to the sleeve and extending at least partially around the latter
- means of supporting the cathode in the gun, and is characterized in that the cathode has a second eyelet disposed at least partially around the first at a distance from the latter such that the two eyelets are securely attached to each other at one of their ends.

BRIEF DESCRIPTION OF THE DRAWINGS

The invention and its advantages will be better understood from the description below and the drawings, in which.

DETAILED DESCRIPTION OF PREFERRED EMBODIMENTS

An electron gun for cathode ray tube comprises at least one emissive cathode designed to generate an electron beam to scan a screen of luminescent materials to generate a picture on the surface of the latter.

Figure 1:
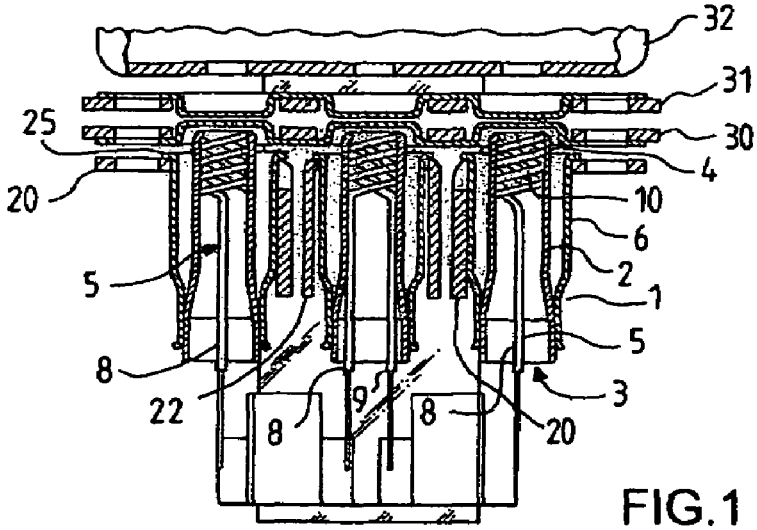
FIG. 1 represents a cross-sectional view of a part of an electron gun for cathode ray tube according to the state of the art.

As illustrated by FIG. 1, by a cross-sectional view, the cathode 1 according to the state of the art comprises a roughly cylindrical tubular sleeve 2 with an open end 3 and an end closed by a cap 4. A layer of thermo-emissive material is deposited on the cap. The open end of the sleeve is normally flared so as to facilitate the insertion of a heating filament 5. The heating element of the filament 10 is concentrated on the part nearest to the emissive cap to reduce the power to be supplied to enable emission. The filament is powered by two legs 8, 9, at the end of the flared part of the sleeve 2. The legs of the filament are welded to rigid straps securely attached to the structure of the gun through electrically non-conductive parts, for example made of glass. The cathode also comprises an eyelet 6 surrounding, at least partially, the cathode sleeve, and securely attached to the latter normally by welding at the bottom part of the cathode sleeve. The eyelet 6 is preferably made of stainless steel, for example stainless steel 305, an inexpensive material offering good thermal inertia, whereas the cathode sleeve is made of nickel-chromium alloy with, for example, 80% nickel and 20% chromium; these two parts are produced in small thicknesses, measured in hundreds of μm for the eyelet and 50 or so μm for the sleeve, this to avoid the high thermal losses, the low thickness of the sleeve reduces its weight to facilitate the thermal transfer between the filament and the cathode and limit power consumption.

Moreover, with this structure, the thermal expansions of the sleeve and the eyelet are compensated to avoid significant movements of the cathode towards the electrode 30 when the tube is operating.

Rigid support means 20, 21, 22, conventionally linked to the body of the gun, are used to keep the emissive surface of the cathode at the nominal distance from the electrode 30 disposed facing this surface. The cathode eyelets normally include, in their end opposite to the end linked to the sleeve, shoulders 25 designed to rest on the support means and be securely attached by welding to the latter.

The gun furthermore comprises a succession of electrodes 31, 32, etc, designed to shape the electron beams from the cathodes.

Figure 2:
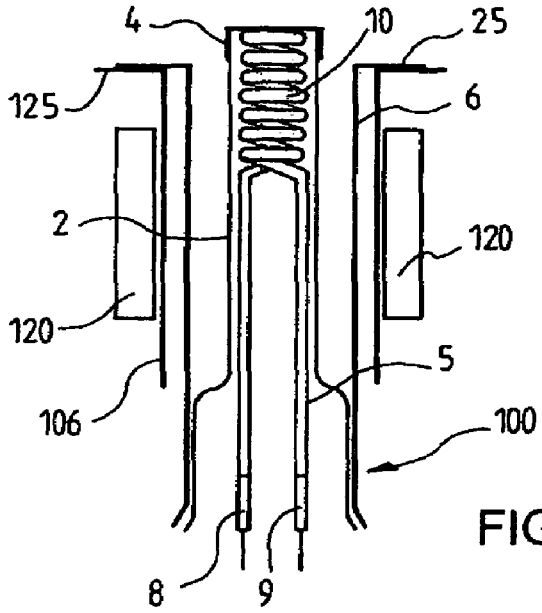
FIG. 2 illustrates, by a cross-sectional view, a cathode structure for cathode ray tube according to the invention.

This structure gives a consumption of approximately 2.3 W to 2.4 W for the three cathodes of a typical colour cathode ray tube. Detailed analysis using simulation results shows the contribution of the various elements of the structure to the overall consumption:

With reference to FIG. 2, the cathode structure according to the invention comprises a filament (5), a cathode sleeve (2), a roughly cylindrical straight eyelet (6) with, at one of its ends, a shoulder (25), a second roughly cylindrical straight eyelet (106) also with a shoulder at its top end (125); a rigid eyelet support (120) providing the link between the cathode structure described above and the glass beads for obtaining the final and definitive positioning of the various component elements of the gun is securely attached to the outer surface of the second eyelet 106. The second end 100 of the first eyelet 6 is securely attached to the other eyelet, for example by welding at the open, slightly flared end of the cathode sleeve. The two eyelets 6 and 106 are assembled concentrically and are maintained relative to each other by a number of weld spots at the top shoulders of the two parts, the welding being done on the flat part to facilitate bearing support and extend the thermal path. The shoulders enable the two parts to be assembled relative to each other quickly and accurately.

The two eyelets are concentric to each other and the facing surfaces are kept at a distance from each other, the two eyelets being in contact with each other only at their shouldered end part.

Figure 3:
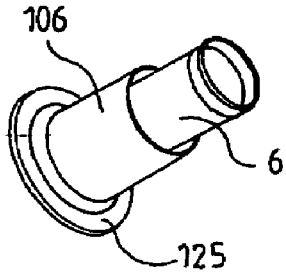
FIG. 3 illustrates, by an isometric perspective view, a double cathode eyelet according to the invention.

FIG. 3 illustrates, by a perspective view, the final structure of the double eyelet system according to the invention.

The eyelet structure according to the invention, compared to the state of the art illustrated by FIG. 1 comprising a single eyelet, increases the length of the conduction path between the weld spot securing the cathode sleeve (2) to the eyelet and the area in which the cathode is attached to the support means 120 in the gun. By increasing the length of the thermal link between the cathode sleeve and the support means, this structure increases the temperature gradient between said cathode sleeve and said means, and therefore reduces the losses by thermal conduction and consequently shortens the cathode switch-on time while reducing its consumption.

Compared to the single-eyelet structure, experience shows that, to obtain a notable effect on the electrical consumption, the second, outer eyelet 106 should extend longitudinally so as to cover in this direction at least 50% of the length of the first eyelet 6.

In another embodiment of the invention derived from the above, the inner eyelet 6 has been subjected to a polishing process, preferably on both sides, to give the latter reflective-surface properties. It has been noted that, from a thermal point of view, a polished surface, the surface properties of which are characterized by low roughness, emits less heat flux than a surface having a high roughness, given equal temperature and area. Similarly, a polished surface receiving a heat flux from any source is less absorptive to the heat flux than a surface having a high roughness, given equal temperature and area, because a portion of the incident flux received is reflected by the surface and dissipates into the near environment.

Consequently, the radiative flux emitted by the inner surface of the first eyelet (6) of the cathode is mostly reflected towards the cathode sleeve; the outer surface of said eyelet (6), facing the second eyelet, is advantageously also polished, which limits the thermal emission towards the second eyelet (106) and therefore reduces the radiative losses towards the latter.

The polishing of the eyelet can be achieved mechanically or electrochemically.

The eyelets 6 and 106 are, for example, made of type 305 stainless steel which is an alloy commonly used because it is inexpensive. Their thicknesses are respectively 100 μm for the eyelet 6 and 122 μm for the eyelet 106 which gives sufficient rigidity for the assembly operations and, where appropriate, for the various steps in which the parts are handled by personnel.

For a cathode according to the invention, comprising a double eyelet 6 and 106 with polished surfaces for the innermost eyelet 6, a study of the power loss gives the following analysis:

| | |
|---|---|
| Power lost by the filament by conduction in the legs | 0.13 W (19%) |
| Power lost by the filament by radiation | 0.09 W (13%) |
| Power lost by the cathode by radiation | 0.29 W (41%) |
| Power lost by the cathode by conduction | 0.19 W (27%) |
| Total consumed power | 0.70 W (100%) |

It is thus possible to reduce the consumption of the three cathodes to the required level of 2.1 W in total, this without modifying the structure of the parts of the gun by replacing a single eyelet according to the state of the art with a double eyelet.

The embodiments described above are not limiting. Since the shapes of the eyelets must be suited to the structure of the gun in which they are inserted, their shape can, for example, be different from that of a straight cylinder.

What is claimed is:

1. A cathode structure for cathode ray tube electron gun comprising:

an oxide cathode;

a cathode sleeve open at one of its ends and closed at its opposite end by a cap covered with emissive materials;

a heating filament positioned inside the sleeve and comprising a heating element and two legs extending towards the open end of said sleeve;

a first cathode unitary shaped eyelet securely attached to the sleeve extending at least partially around the latter;

rigid means of supporting the cathode in the gun, wherein the cathode comprises a second unitary shaped eyelet positioned at least partially around the first at a distance from the latter, the eyelets including a shoulder at one their ends such that the two eyelets are securely attached to each other at such ends.

2. The cathode structure according to claim 1, wherein the eyelets are securely attached to each other at their shoulders.

3. The cathode structure according to claim 1, wherein the two eyelets are roughly cylindrical in shape.

4. The cathode structure according to claim 1, wherein the second eyelet longitudinally covers at least half the length of the first eyelet.

5. The cathode structure according to claim 1, wherein the two eyelets are securely attached to each other at their end that is nearest to the cathode.

6. The cathode structure according to claim 1, wherein the two eyelets are made of stainless steel.

7. The oxide layer cathode according to claim 1, wherein the outer surface of the first eyelet situated facing the second eyelet is polished.

8. The oxide layer cathode according to claim 1, wherein the inner surface of the first eyelet situated facing the heating filament is polished.

9. The cathode structure according to claim 1, wherein the rigid means are securely attached to the cathode structure at the outer surface of the second eyelet.

* * * * *